US006047750A

United States Patent [19]

Jensen

[11] Patent Number: 6,047,750

[45] Date of Patent: Apr. 11, 2000

[54] MODULAR UTILITY STAND STORAGE APPARATUS AND METHOD

[76] Inventor: Steven M. Jensen, 5554 Lakeview Ave., White Bear Lake, Minn. 55110

[21] Appl. No.: 09/270,727

[22] Filed: Mar. 17, 1999

Related U.S. Application Data

[60] Provisional application No. 60/078,352, Mar. 17, 1998.

[51] Int. Cl.[7] ..... B25H 1/12; B27C 9/00

[52] U.S. Cl. ..... 144/286.1; 108/34; 108/56.1; 108/26; 108/97; 144/285; 144/287; 312/237

[58] Field of Search ..... 144/1.1, 285, 286.1, 144/286.5, 287; 83/471.3; 108/28, 33, 34, 56.1, 56.3, 92, 96, 97, 101; 312/237, 277; 269/41, 289 R, 901

[56] References Cited

U.S. PATENT DOCUMENTS

| | | | |
|---|---|---|---|
| 1,063,046 | 5/1913 | Lathrop . | |
| 2,662,566 | 12/1953 | Kurschner . | |
| 3,070,138 | 12/1962 | Baasland . | |
| 3,118,685 | 1/1964 | Jordan . | |
| 3,342,226 | 9/1967 | Marcoux et al. . | |
| 3,615,087 | 10/1971 | Hickman . | |
| 3,771,848 | 11/1973 | Claywell . | |
| 4,068,551 | 1/1978 | Kreitz | 144/286.1 |
| 4,073,484 | 2/1978 | Beekenkamp . | |
| 4,155,386 | 5/1979 | Alessio . | |
| 4,335,765 | 6/1982 | Murphy . | |
| 4,389,078 | 6/1983 | Streit . | |
| 4,694,720 | 9/1987 | Brickner, Jr. et al. . | |
| 4,733,703 | 3/1988 | Cimino . | |
| 4,798,113 | 1/1989 | Viazanko . | |
| 4,846,453 | 7/1989 | Salotto . | |
| 4,860,807 | 8/1989 | Vacchiano . | |
| 4,874,025 | 10/1989 | Cleveland . | |
| 4,953,601 | 9/1990 | Herdies . | |
| 4,974,651 | 12/1990 | Carmon et al. . | |
| 5,038,650 | 8/1991 | Hodge . | |
| 5,105,862 | 4/1992 | Skinner et al. . | |
| 5,161,590 | 11/1992 | Otto . | |
| 5,193,598 | 3/1993 | Estrem . | |
| 5,224,531 | 7/1993 | Blohm . | |
| 5,320,150 | 6/1994 | Everts et al. . | |
| 5,462,102 | 10/1995 | Searfoss . | |
| 5,518,053 | 5/1996 | Robison . | |
| 5,829,501 | 11/1998 | DeVito | 144/286.1 |
| 5,884,681 | 3/1999 | Nickles | 144/286.1 |

FOREIGN PATENT DOCUMENTS

| | | | |
|---|---|---|---|
| 427500 | 4/1926 | Germany | 144/285 |
| 2810401 | 9/1979 | Germany | 144/285 |
| 3022515 | 12/1981 | Germany | 144/285 |

*Primary Examiner*—W. Donald Bray
*Attorney, Agent, or Firm*—Merchant & Gould P.C.

[57] ABSTRACT

A modular utility stand storage apparatus includes a plurality of components for storage/transport and utility stand operations. The components are stacked on top of one another in a utility stand mode (use mode) and collapsible into one another in a storage/transport mode (non-use mode). The apparatus also includes a platform which can serve as a working platform or a handle for storage/transport. The stacked utility stand storage apparatus provides various working heights, and the collapsed utility stand storage apparatus is compact in size and easily lifted and portable.

17 Claims, 5 Drawing Sheets

MODULAR UTILITY STAND STORAGE APPARATUS AND METHOD

Prov. appln. 60/078352, filed Mar. 17, 1998.

FIELD OF THE INVENTION

The present invention relates in general to a collapsible, portable, and adjustable utility stand apparatus, more particularly to a collapsible, portable, and adjustable combination of a utility stand and a storage unit, and further more particularly to a collapsible, portable, and adjustable combination of a modular utility stand and a storage unit.

BACKGROUND OF THE INVENTION

Working tools, such as miter saws, are widely used in carpentry due to their ability to make precise cuts in a variety of materials very quickly. Transporting of these tools becomes easier due to their compact design. Portable table saws are also very popular for much of the same reasons. However, a saw bed or support platform in order to adequately support a material an operator wishes to cut is not yet very compact or easy to store/transport. To elevate a saw to a comfortable work height, a carpenter often sets up saw horses with a large piece of plywood on the top to create a table for these tools. The carpenter still needs to extend the top elevation of the saw bed by building up the table on either side of the saw with material which dimensionally adds up to the saw table thickness or to set up adjustable roller stands on either side of the saw, thus lending a support to the material to be cut and adding to the overall set up time.

U.S. Pat. Nos. 5,462,102, 4,860,807, 5,320,150, 4,874,025, 5,497,816, and 4,974,651 describe various saw tables that have addressed the problem of lifting and supporting a saw off the ground with an adjustable stock support to rest work pieces on in order to safely cut them. The problems that are not addressed in these patents are: (1) the ability to accommodate other bench top tools since tools, such as miter saws, are not the only tools that would benefit from a table with stock supports, (2) limited or lack of storage space for other tools, and (3) the inherently bulky features of utility/table stands in storage/transport mode.

Another aspect of carpentry is the large quantity of tools required. There has been virtually always a need to store, organize, and transport these tools, in combination with a portable work bench. Various attempts have been made to design a work bench that is portable and has a tool storage capacity. U.S. Pat. Nos. 5,224,531, 4,953,601, 3,771,848, and 3,118,685 describe various designs to store, organize, and transport a large assortment of tools. A problem exists in these patents with the size of a tool chest. In order to be a work bench that is of a sufficient work height, the tool chest sacrifices portability. Conversely, if the tool chest is of a size that can easily be loaded into a vehicle, the tool chest sacrifices the height that would be comfortable to work on as a work bench.

It can be seen that there is a need for an improved utility stand storage unit which has a comfortable working height as well as being capable of collapsible, portable, and adjustable. There is also a need for such a utility stand storage unit to be modular and easy to set up.

SUMMARY OF THE INVENTION

To overcome the limitations in the prior art described above, and to overcome other limitations that will become apparent upon reading and understanding the present specifications, the present invention provides a utility stand storage unit. The unit is collapsible, compact to be portable, adjustable, and suitable for various working heights. The present invention also provides a plurality of modular utility stand storage units. The modular utility stand storage units can be assembled together to form a large working platform.

In one embodiment according to the present invention, the utility stand storage unit includes first, second, and third components, wherein the components may have at least one storage space. The second component is collapsible with the third component, and the first component is collapsible with the second and third components. The collapsed unit is compact in size and is readily portable by a handle. The handle can be used as a working platform when the unit is in a use mode. In the use mode, the second component can be stacked onto the third component. The first component can be stacked onto the second component. The first component include a plurality of members for adjusting the height of the platform in the use mode.

Further in one embodiment, the platform may include at least one supporting leg to support the platform with respect to the unit. The platform may be mounted with the collapsed unit to serve as a handle.

In another embodiment according to the present invention, a plurality of modular utility stand storage units can be arranged and configured to be attached to each other. Each of the modular utility stand storage units includes first, second, and third components as described above. The platforms are used to connect each of the units together. The dimension of each modular utility stand storage unit allows the platforms to be disposed in longitudinal or perpendicular positions.

Further in one embodiment according to the present invention, each of the three components includes support legs. The support legs arc configured and arranged to be capable of stacking over one another in the use mode and of collapsing into each other in the non-use mode. The collapsed apparatus is compact in size and is readily portable. In the use mode, the second component can be stacked onto the third component. The first component can be stacked onto the second and third components. The platform is attached to the first component and may be supported by its leg(s) or the first component of another unit. The height of the platform can be adjusted either by adjusting the length of its leg(s) or by adjusting the height of the connection point to the other unit.

In addition to the above discussed features and advantages of the present invention, several other features and advantages of the present invention are:

(a) it provides a utility stand (or tool stand) which is capable of accommodating several different bench top tools;

(b) it provides a utility stand which is capable of storing and organizing other tools in a manner that keeps the tools organized largest to smallest;

(c) it provides a utility stand that can be attached and used in conjunction with other utility stands of the similar type to expand and enhance the utility station in the work station mode (or use mode) of operation;

(d) it provides a utility stand that is also a portable tool chest that can easily be loaded into a vehicle;

(e) it provides a utility stand that reduces the amount of space taken up from small tool boxes and saw stands when storing;

(f) it provides a utility stand that assists the activity that can benefit from a portable storage container with the ability to transform into a table and further have a height adjustment in the table sufficient to satisfy many applications, such as a computer desk, etc.;

(g) it provides a utility stand simple in design for manufacture;

(h) it provides a utility stand that simplifies vehicle packing plans; and (i) it provides a utility stand that reduces the number of trips to and from a vehicle when unloading and/or loading equipment.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described specific examples of an apparatus in accordance with the invention.

DETAILED DESCRIPTION OF THE PREFERRED EMBODIMENT

In the following description of the exemplary embodiment, reference is made to the accompanying drawings which form a part hereof, and in which is shown by way of illustration the specific embodiment in which the invention may be practiced. It is to be understood that other embodiments may be utilized as structural or implementing changes may be made without departing from the scope of the present invention.

The present invention provides a utility stand storage unit. The unit is collapsible, compact to be portable, adjustable, and suitable for various working heights. The present invention also provides a plurality of modular utility stand storage units. The modular utility stand storage units can be arranged and configured to form multiple working platform utility stands.

Configurations for carpentry are used to teach the functionality of the subject invention. The following examples are a sample of the many applications and configurations that are possible.

Figure 1:
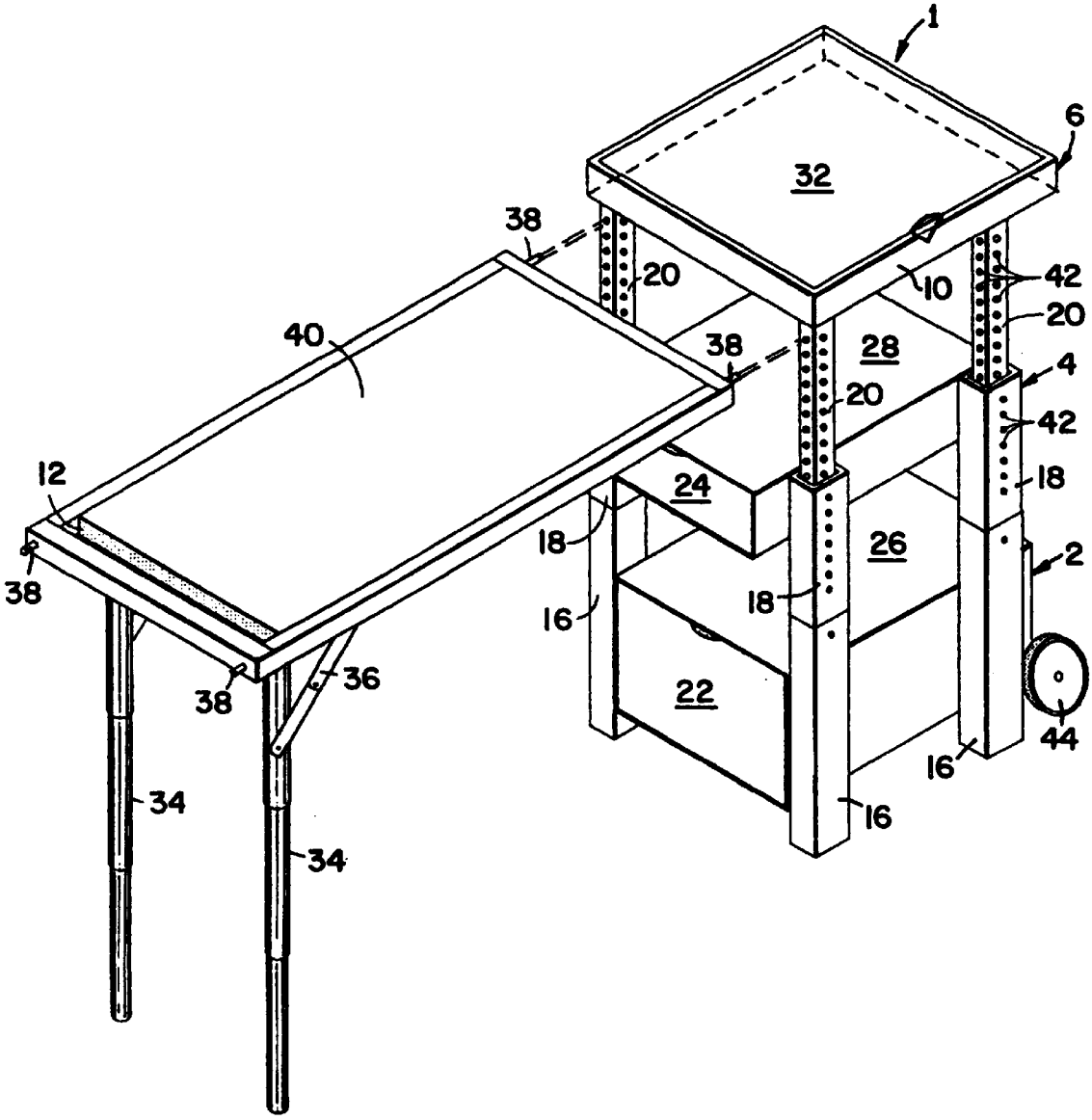
FIG. 1 shows a perspective view of a modular utility stand storage unit in a work station mode in accordance with the principles of the present invention.
Figure 2:
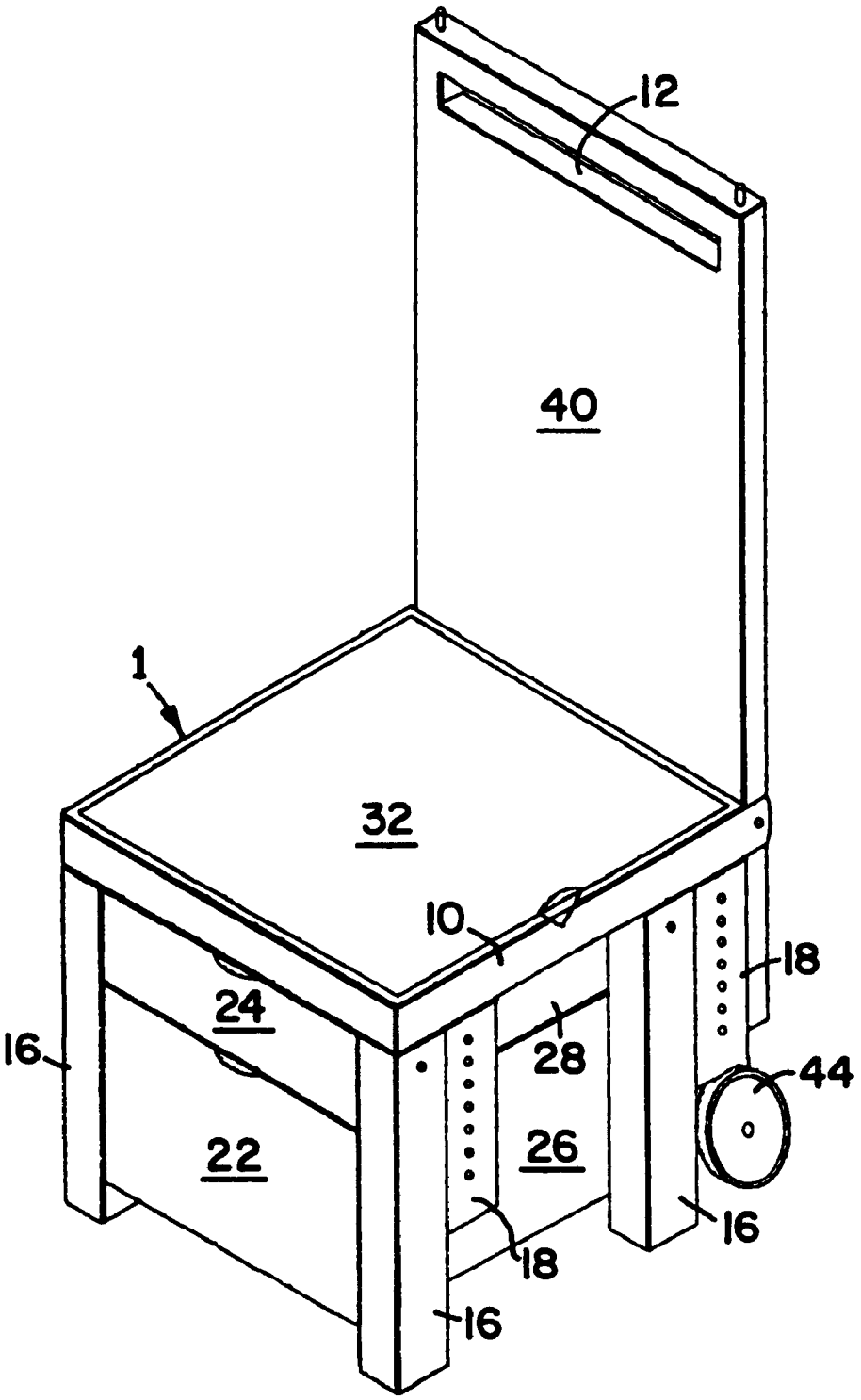
FIG. 2 shows a perspective view of the modular utility stand storage unit in a collapsing (dolly) form in accordance with the principles of the present invention.
Figure 3:
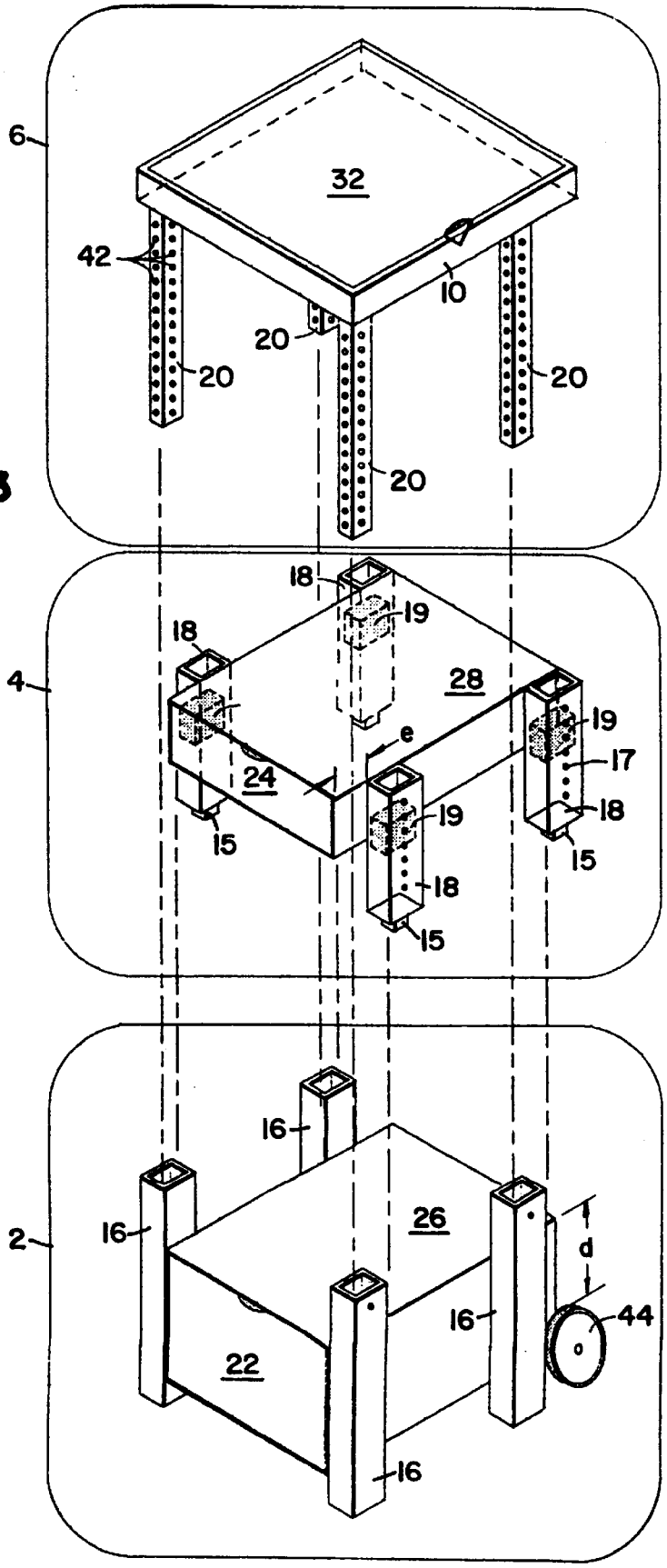
FIG. 3 shows an exploded view of the modular utility stand storage unit in accordance with the principles of the present invention.

Referring now more particularly to the drawings, FIG. 3 shows an exploded view of one embodiment of a modular utility stand storage unit 1 according to the present invention. The modular utility stand storage unit 1 includes three separate but interconnected components: a bottom component 2, a middle component 4, and a top component 6. A pair of wheels 44 may be mounted at the back of the bottom component 2. FIGS. 1 and 2 respectfully show a multipurpose platform or table/handle 40 that can be connected horizontally to the modular utility stand storage unit 1 for a table use when modules vertical supports 16, 18, 20 are lineally stacked creating an elevated work surface 32 as shown in FIG. 1. The platform 40 can also be installed vertically onto the modular utility stand storage unit 1 as shown in FIG. 2, similar to that of a hand truck. In FIG. 2, the modular utility stand storage unit 1 is in a collapsing mode (non-use mode, or storage mode, or transport mode). The middle component 4 is collapsed into the bottom component 2, and the top components 6 is collapsed into the middle and bottom components 4,2. The top component 6 has vertical support legs 20, each of which may include a plurality of adjustment holes 42. The middle component 4 has vertical support legs 18, each of which may include a plurality of adjustment holes 17. The adjustment holes 17 may be aligned with the adjustment holes 42 of the top component 6. The vertical support leg 18 also includes an obstruction block 19 internally located in the vertical support leg 18. It is appreciated to a person skilled in the art that the obstruction blocks 19 can be adjustable or fixable inside the legs 18. When the modular utility stand storage unit 1 is in a use mode, the legs 20 can be at least partially, telescopically received inside the legs 18 and supported by the obstruction blocks 19. The bottom component 2 has vertical support legs 16. The legs 16 may receive extension portions 15 of the legs 18 and retain the legs 18 on the top of the legs 16 when the modular utility stand storage unit 1 is in the use mode. In a storage mode, the legs 18 are disposed on the side of the legs 16 respectively, and the legs 20 of the top component 6 are telescopically received inside the legs 16. Accordingly, the top component 6 is collapsed into the middle and bottom components 4, 2. As shown in FIG. 2, the vertical supports 16, 1 8 are disposed adjacent to each other and the vertical supports 20 are disposed inside of the vertical supports 16, thereby creating a compact unit for transport or storage. The platform in FIG. 2 may be mounted on the back side of the modular utility stand storage unit 1 to be used as a handle for transportation in association with the wheels 44.

Further in FIG. 3, the bottom component 2 may also include a drawer 22 housed in a frame 26. The vertical support legs 16 extend outside of the frame 26. The legs 16 may have a length as long as the sum of the height of the frame of the bottom component 2, a frame 28 of the middle component 4, and the distance that the wheels 44 lift the module utility stand storage unit 1 off the ground. Two of the vertical support legs 16 are attached to the side corners in the front of the frame 26 of the bottom component 2, and the other two legs 16 are attached to the side between the front and back of the frame 26 but adjacent to the wheels 44. A distance, d, between the top of the wheels 44 and the top of the frame 26 provides clearance for the legs 18 to be disposed adjacent to the legs 16 in the storage/transport mode as shown in FIG. 2.

Further in FIG. 3, the middle component 4 may also include a drawer 24 housed in the frame 28. The frame 28 attaches to the vertical support legs 1 8 proximate the side corners much like the frame 26 attaches to the vertical supports 16 in the bottom component 2, except that the two vertical support legs 18 at the front (at the drawer side) are set back from the front corners a distance, e, approximately equal to the dimension of the vertical support legs 16, and that the two vertical support legs 18 at the back (at the wheel side) are disposed at the back corners of the frame 24. Accordingly, the vertical support legs 18 are offset from the vertical support legs 16. The offset allows the vertical support legs 18,16 of the two components 2, 4 to mesh together for storage and transport as shown in FIG. 2.

Figure 4A:
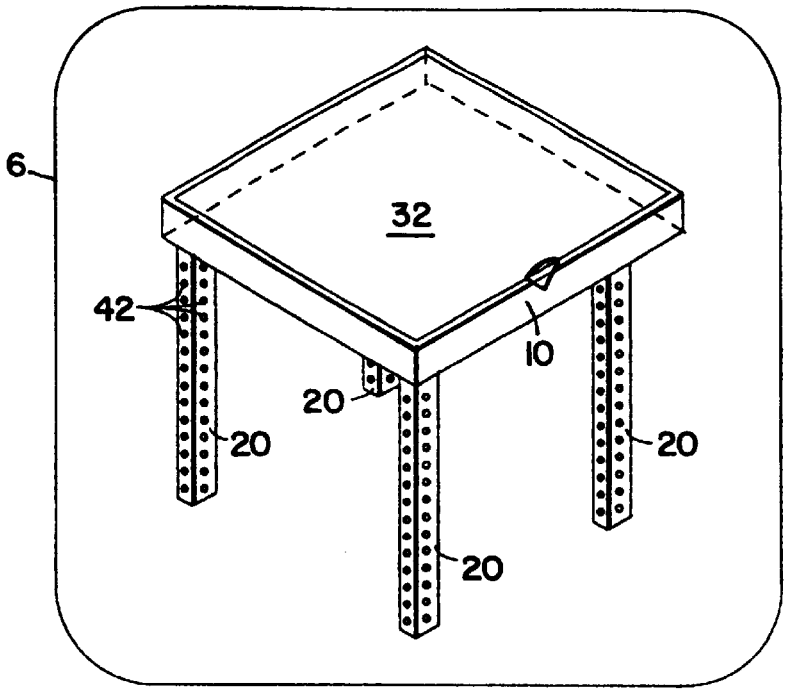
FIG. 4A shows a perspective view of a top component of the unit with a lid closed in accordance with the principles of the present invention.
Figure 4B:
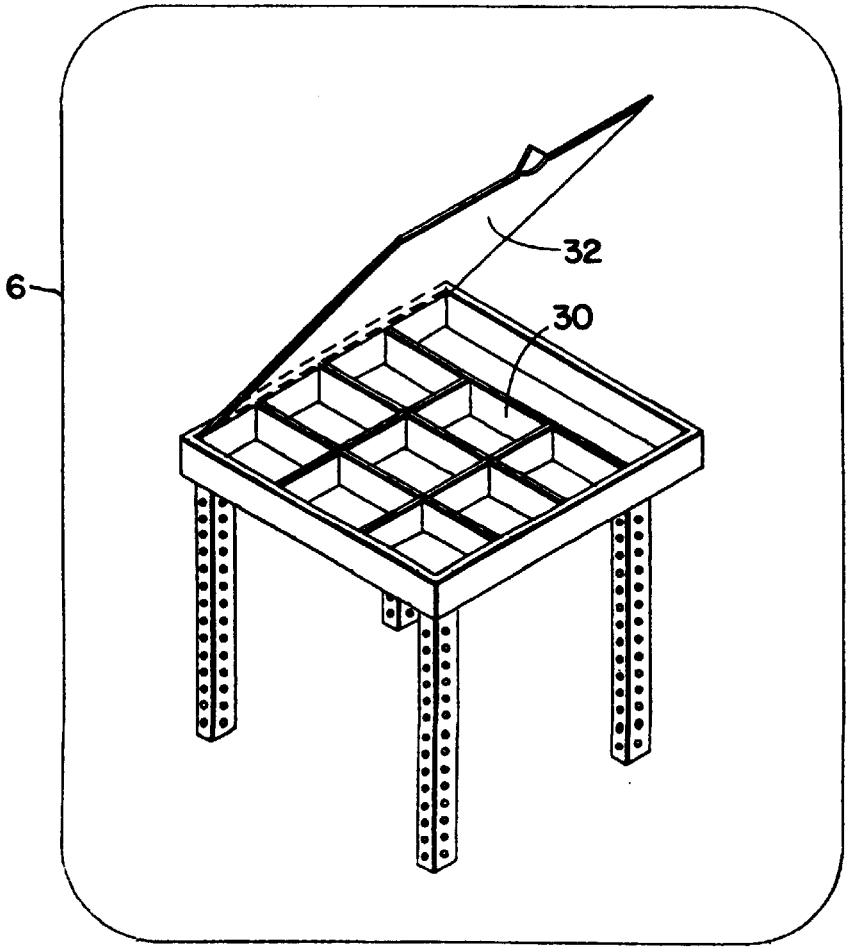
FIG. 4B shows a perspective view of the top component of the unit with the lid open to reveal one arrangement of the storage compartments in accordance with the principles of the present invention.

FIGS. 4A and 4B show the top component 6 of the module storage unit 1. The top component 6 may include a frame 10 having the working surface or lid 32. The frame 10 may house a plurality of storage trays 30 for storing, for example, working tools, hardware, and office supplies, etc. The frame 10 also secures the vertical support legs 20 that arc dimensioned to slide within the vertical support legs 16 in the storage mode and within the vertical support legs 18 in a use mode (or work station mode). The vertical support legs 20 may have a length approximately equal to the sum of the height of the legs 16. The position of the vertical support legs 20 may be identical to the vertical support legs 16 so as to allow the vertical support legs 20 of the top component 6 to slide within the vertical support legs 16 of the bottom component 2. The vertical support legs 20 may include the adjustment holes 42 to receive the pins 38 for multiple height settings of the modular utility stand storage unit 1.

As an example, FIG. 1 shows the platform or table/handle 40 horizontally positioned for the work station mode (or use mode). FIG. 2 shows the platform 40 vertically positioned for the storage/transport mode (or non-use mode). The platform 40 may include a handle grip 12. The handle grip 12 may be configured as a lateral slot on one end of the platform 40 utilized in the storage/transport mode. The platform 40 may also include foldable support legs 34. The legs 34 can be pivoted to a perpendicular position from a parallel position relative to the platform 40. The support legs 34 may be locked into the perpendicular position with folding angle brace(s) 36. The support legs 34 may be telescopic to adjust to many different heights and may be locked into a position using a frictional stopping method.

A single module storage unit or work station is illustrated in FIG. 1. This configuration can be implemented in the following exemplary six steps from a storage/transport mode (non-use mode) of operation to a work station mode (use mode) of operation:

Step One: remove the platform or handle/table 40 from the storage module unit 1 and set aside;

Step Two: lift the top component 6, separate the top component 6 from the bottom and middle components 2, 4 and set aside;

Step Three: lift the middle component 4 and set its vertical support legs 18 on top of the vertical support legs 16 of the bottom component 2;

Step Four: slide the vertical support legs 20 of the top component 6 into the vertical support legs 18 of the middle component 4 to rest on the obstruction blocks 19 inside of the vertical support legs 18 of the middle component 4. The top component 6 of the modular utility stand storage unit 1 is now elevated to a comfortable working height which subsequently becomes the support after longitudinally attaching the platform 40;

Step Five: slide the pins 38 at one end of the platform 40 into the adjustment holes 42 of the vertical support legs 20 of the top component 6;

Step Six: support the other end of the platform 40 by pivoting the telescopic legs 34 from the parallel position to the perpendicular position relative to the platform and allowing the legs 34 to slide into contact with the ground at which time the legs 34 are locked into position by an adjustment lever or leg clamp collar or the like. The adjustment level or leg clamp or the like is known to a person skilled in the table art thus is not shown in the drawing. The legs are also locked into the perpendicular position with the folding braces 36. Adjustment in the support legs 34 allows to match the adjustable horizontal elevation set at the platform 40 with the connection point of the modular utility stand storage unit 1. The adjustment in the support legs 34 also allows the unit 1 to be used in an uneven terrain. Alternatively, the pins 38 at the other end of the platform 40 slide into the adjustment holes 42 of the top component of another unit.

Figure 5:
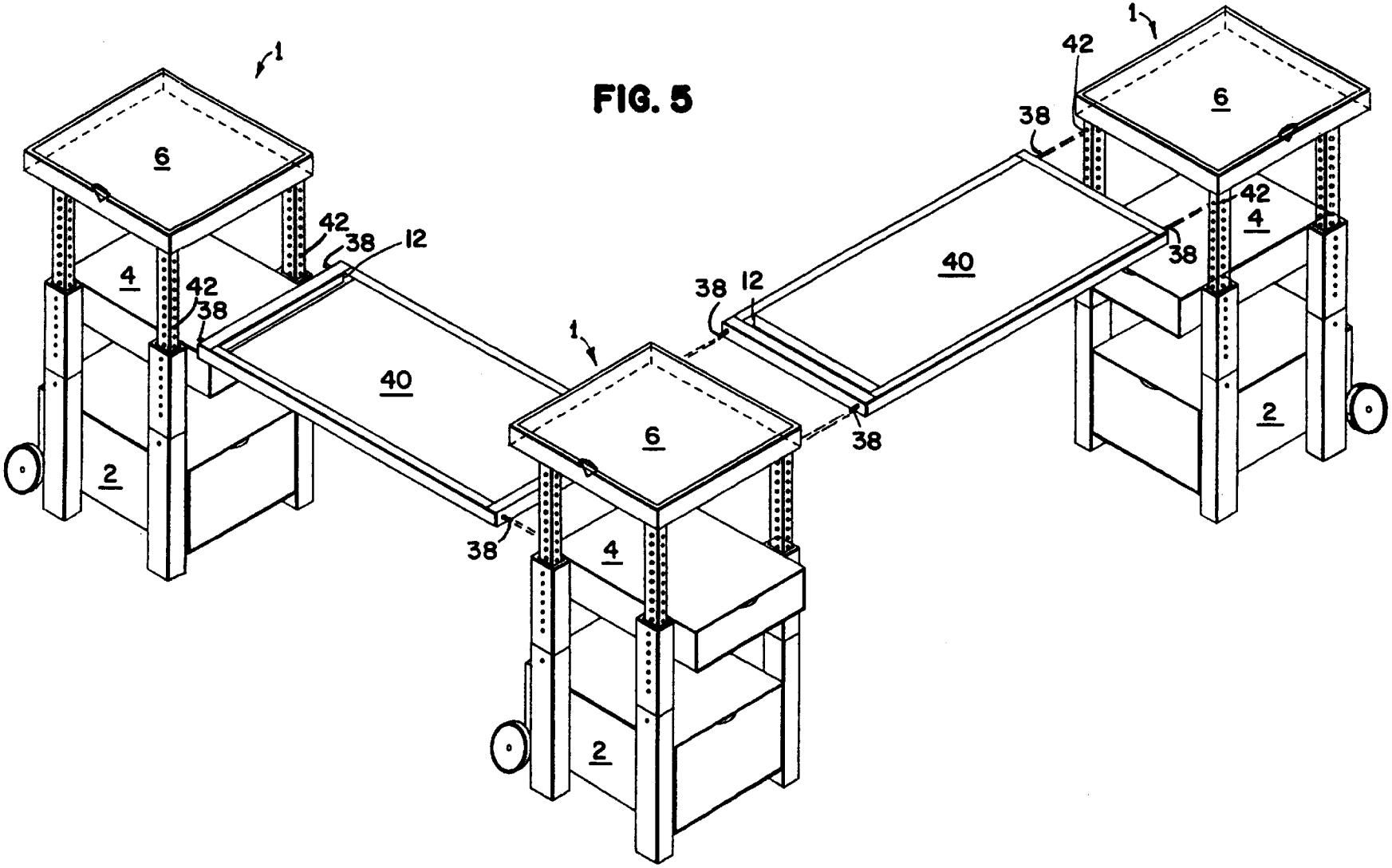
FIG. 5 shows a perspective view of one exemplary arrange of a multiple modular utility stand storage units for an expanded work station mode of operation.

As shown in FIG. 5, multiple modular utility stand storage units 1 can be utilized in conjunction with each other. In FIG. 5, three modular units 1 arc shown as an example. Two modular units 1 are set up longitudinally, and the third one 1 is set up perpendicularly to the two. It is appreciated that equal spacing between the vertical support legs 20 may allow the platforms 40 to be placed in vertical and/or longitudinal positions with respect to each other. A space large enough to receive the platform 40 is left between each modular unit 1. The platforms 40 are supported on each end by sliding the pins 38 into adjustment holes 42 located on the vertical support legs 20 of the top modules 6.

The storage/transport mode of operation is illustrated in FIG. 2. The operation is accomplished by collapsing the components 6,4,2 down upon themselves. The frame 28 of the middle component 4 rests directly on the frame 26 of the bottom component 2. The vertical support legs 18 of the middle component 4 mesh adjacent to the vertical support legs 16 of the bottom component 2. The frame 10 of the top component 6 rests directly on top of the frame 28 of the middle component 4. The vertical support legs 20 of the top component 6 slide inside of the vertical support legs 16 of the bottom component 2. The platform 40 is attached to the back of the storage module unit 1 above the wheels 44.

The foregoing description of the exemplary embodiment and operation of the invention has been presented for the purposes of illustration and description. It is not intended to be exhaustive or to limit the invention to the precise form disclosed. Many modifications and variations are possible in light of the above teaching. For example, the modular utility stand storage unit(s) can be used for computer work station (s) or office table(s), etc. Further, there may be more than one storage drawer/frame that can be implemented in the modular utility stand storage unit. It is intended that the scope of the invention be limited not with this detailed description, but rather by the claims appended hereto.

What is claimed is:

1. A modular utility stand storage apparatus, comprising:

a first component having a first set of legs and a first storage housing;

a second component having a second set of legs and a second storage housing, the first component being stacked on top of the second component in a use mode;

a third component having a third set of legs and a third storage housing, the second component being stacked on top of the third component in the use mode, the second component being collapsed with the third component and the first component being collapsed with the second and third components in a non-use mode; and wherein during the non-use mode, the first set of legs are received in the third set of legs, the second set of legs are disposed adjacent and offset from the third set of legs, the first storage housing rests on top of the second storage housing, and the second storage housing rests on top of the third storage housing, and during the use mode, the first set of legs are at least partially received in the second set of legs, and the second set of legs are at least partially received in third set of legs.

2. The modular utility stand storage apparatus according to claim 1, further comprising a platform having a connecting member at one end, the first component having a plurality of vertical adjustment holes, wherein during the use mode, the connecting member is capable of inserting into the adjustment holes to adjust a height of the platform.

3. The modular utility stand storage apparatus according to claim 2, wherein the platform includes a foldable leg proximate the other end to support the platform at a certain height, the foldable leg is capable of being extended and retracted.

4. The modular utility stand storage apparatus according to claim 2, wherein the platform includes a second connecting member at the other end, the second connecting member is capable of inserting into adjustment holes of a second modular utility stand storage apparatus.

5. The modular utility stand storage apparatus according to claim 2, wherein during the non-use mode, the platform is capable of mounting onto the one of the first, second, and third components to serve as a handle for transportation.

6. The modular utility stand storage apparatus according to claim 5, further comprising at least one wheel to transport the apparatus in the non-use mode inassociation with the handle.

7. The modular utility stand storage apparatus according to claim 1, wherein a clearance is defined by the third set of legs and the third housing to receive each of the second set of legs adjacent and along the third set of legs, and to allow the first set of legs directly collapsed into the third set of legs in the non-use mode.

8. The modular utility stand storage apparatus according to claim 1, wherein the first set of legs are disposed on a bottom surface of the first storage housing.

9. The modular utility stand storage apparatus according to claim 8, wherein the second set of legs are disposed along two sides of the second storage housing.

10. The modular utility stand storage apparatus according to claim 9, wherein the third set of legs are disposed along two sides of the third storage housing.

11. The modular utility stand storage apparatus according to claim 1, wherein the first storage housing houses a plurality of storage compartments.

12. The modular utility stand storage apparatus according to claim 1, wherein the second storage housing houses at least one storage drawer.

13. The modular utility stand storage apparatus according to claim 1, wherein the third storage housing houses at least one storage drawer.

14. A multiplicity of modular utility stand storage apparatuses, each of the apparatuses comprising:

a first component having a first set of legs and a first storage housing;

a second component having a second set of legs and a second storage housing, the first component being stacked on top of the second component in a use mode;

a third component having a third set of legs and a third storage housing, the second component being stacked on top of the third component in the use mode, the second component being collapsed with the third component and the first component being collapsed with the second and third components in a non-use mode;

wherein during the non-use mode, the first set of legs are received in the third set of legs, the second set of legs are disposed adjacent and offset from the third set of legs, the first storage housing rests on top of the second storage housing, and the second storage housing rests on top of the third storage housing, and during the use mode, the first set of legs are at least partially received in the second set of legs, and the second set of legs are at least partially received in third set of legs; and at least one platform having a first connecting member at one end and a second connecting member at the other end, the first and second connecting members being inserted into the first components of two adjacent apparatus.

15. A modular utility stand storage apparatus, comprising:

a plurality of components, each having legs supporting one another in a use mode and collapsing onto one another in a non-use mode; and a platform being attached to one of the components with an adjustment member to adjust height of the platform in the use mode, and being attached to one of the components to serve as a handle for transportation.

16. A modular utility stand storage apparatus of claim 15, wherein the platform includes a leg to support the platform with respect to the components.

17. A modular utility stand storage apparatus of claim 15, wherein the adjustment member includes an insert pin of the platform and a hole of the component, by inserting the pin into the hole, the height of the platform is adjusted.

* * * * *